US005222432A

United States Patent [19]

Schaede

[11] Patent Number: 5,222,432

[45] Date of Patent: Jun. 29, 1993

[54] WIPING DEVICE OF AN INTAGLIO PRINTING MACHINE

[75] Inventor: Johannes G. Schaede, Wurzburg, Fed. Rep. of Germany

[73] Assignee: De La Rue Giori, S.A., Lausanne, Switzerland

[21] Appl. No.: 957,726

[22] Filed: Oct. 7, 1992

[30] Foreign Application Priority Data

Oct. 17, 1991 [CH] Switzerland ..... 3 049/91-4

[51] Int. Cl.[5] ..... B41F 9/10; B41F 9/16

[52] U.S. Cl. ..... 101/157; 101/425

[58] Field of Search ..... 101/350, 365, 157, 169, 101/167, 155, 154, 207, 208, 209, 210, 148, 423; 118/261, 70

[56] References Cited

U.S. PATENT DOCUMENTS

| | | | |
|---|---|---|---|
| 1,837,671 | 12/1931 | Pirie . | |
| 2,098,750 | 11/1937 | Krahmer . | |
| 3,988,988 | 11/1976 | Sable | 101/169 |
| 4,516,496 | 5/1985 | Giori . | |
| 5,054,392 | 10/1991 | Greenwood | 101/169 |
| 5,085,144 | 2/1992 | Lindstrom et al. | 101/363 |

FOREIGN PATENT DOCUMENTS

| | | |
|---|---|---|
| 282786 | 7/1914 | Fed. Rep. of Germany . |
| 285140 | 3/1928 | United Kingdom . |
| 550287 | 1/1943 | United Kingdom . |
| 1123811 | 8/1968 | United Kingdom . |

OTHER PUBLICATIONS

Search Report Issued in Counterpart Swiss Appln 3049/91 Nov. 14, 1991.

*Primary Examiner*—J. Reed Fisher

*Attorney, Agent, or Firm*—Kane, Dalsimer, Sullivan, Kurucz, Levy, Eisele and Richard

[57] ABSTRACT

The wiping device operates with at least one cylinder (3) which receives the ink raised from the printing plates and against which rests a doctor blade (4) which removes the ink from said cylinder (3). In order to clean the doctor blade (4) reliably from ink during the printing operation, there are mounted on the opposite longitudinal edges of said doctor blade (4) wall parts (6) which are U-shaped in the plan view and whose U-limbs (6*a*) are directed towards one another. Between said U-limbs (6*a*), an ink slide (8) is moved constantly back and forth on the doctor blade surface by a drive device, the side parts of said ink slide facing the wall parts being adapted to the design of said wall parts. Installed on the back of the doctor blade (4) on each side is an ink pump whose slot-shaped inlet opening (12) extends between the U-limbs of the relevant wall part (6). The ink slide (8) which is moved back and forth acts like a displacement body and pushes the ink passing onto the doctor blade alternately into the inside space bounded by the one or by the other wall part (6), where it is conveyed away by the ink pump and fed to a container.

8 Claims, 3 Drawing Sheets

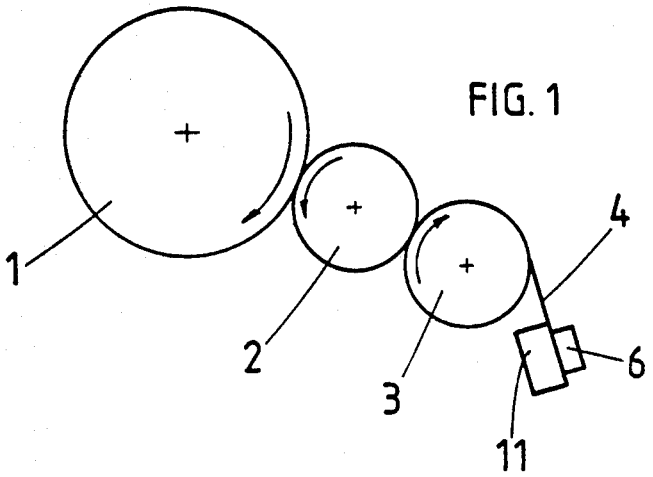
FIG. 1
FIG. 2
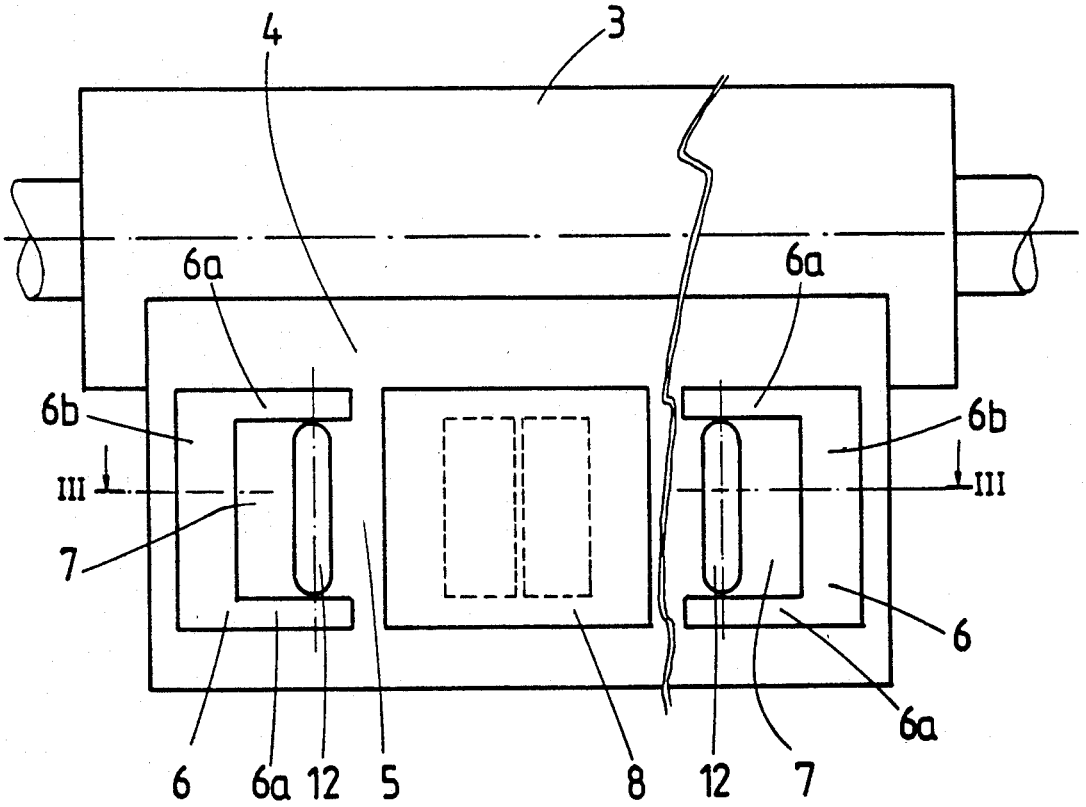

WIPING DEVICE OF AN INTAGLIO PRINTING MACHINE

FIELD OF THE INVENTION

The invention relates to a wiping device of an intaglio printing machine having at least one cylinder onto which the ink raised from the printing plates is transferred, and having a doctor blade resting against said cylinder for removing the ink from the cylinder surface.

PRIOR ART

Wiping devices of this type have been known for a long time and operate either as wiping apparatuses in the true sense with a wiping cylinder which rests against the plate cylinder and completely cleans the intaglio printing plates of ink outside the grooves (for example British Patent Specification 1,123,811), or are constructed as pre-wiping devices (for example U.S. Pat. No 4,516,496) which are installed additionally in front of the actual wiping apparatus in the direction of rotation of the plate cylinder.

In the case of the actual wiping apparatus, the cleaning of the wiping cylinder takes place in such a way that firstly the greatest amount of the ink is removed by a doctor blade and, subsequently, the surface of the wiping cylinder is cleaned completely of the adhering ink with the aid of a suitable cleaning liquid and further cleaning elements.

Pre-wiping devices are generally used in intaglio printing machines with direct inking and have the task of pressing ink, which has previously been applied to the printing plates, into the line grooves and already removing excess ink while the actual wiping takes place subsequently for the purpose of completely cleaning the plate surface.

Known pre-wiping devices either have only one pre-wiping cylinder which rolls off on the plate cylinder and against which rest a doctor blade and, if appropriate, further cleaning elements for removing the ink from the cylinder surface (British Patent Specification 1,123,811), or consist of two cylinders (U.S. Pat. No. 4,516,496), namely a pre-wiping cylinder, which rolls off on the plate cylinder, and a further cylinder which rests on said pre- wiping cylinder and receives the ink from the pre-wiping cylinder and is, in turn, cleaned by a doctor blade and, if appropriate, further cleaning elements.

In the previously known wiping devices, in particular pre-wiping devices, the ink passing onto the doctor blade must be removed from the doctor blade at regular intervals in order to guarantee satisfactory wiping or pre-wiping over a long period. This removal of the ink from the doctor blade has hitherto been carried out by hand by the printer using a spatula, which entails strenuous, frequently repetitive and time-consuming work.

SUMMARY OF THE INVENTION

The underlying object of the present invention is to improve a wiping device, in particular a pre-wiping device, in such a way that the ink is removed from the doctor blade regularly and reliably in a mechanical manner and can be fed to an ink-collecting container.

To achieve this object, the wiping device according to the invention is characterised in that there are arranged on the downwardly inclined doctor blade wall parts which are located laterally opposite one another and, between these wall parts, an ink slide, which is movable back and forth on the doctor blade surface by means of a drive device, in the form of a displacement body adapted on both sides to the wall parts, and in that there is installed on each side below the doctor blade surface an ink pump whose inlet opening opens out on the doctor blade surface and extends along the lower edge of the inner surface of the relevant wall part in such a way that the ink passing between the two wall parts is displaced by the ink slide alternately to the one and to the other inlet opening, where it is conveyed away by the relevant ink pump.

It is thus achieved that the ink flowing down on the doctor blade is displaced to the extent to which it is scraped from the cylinder towards both sides without applying increased pressures, then conveyed away and fed to a container without manual work being required for this purpose.

The arrangement is preferably such that the ink slide and the wall parts are constructed to be complementary to one another in such a way that, prior to the ink slide reaching the one or the other end position, the ink displaced by it passes into a space which is at least virtually completely closed by walls of the ink slide and of the relevant wall part and which is almost completely filled by the ink slide in the end position thereof.

In the plan view, the two wall parts are expediently of U-shaped construction and their U-limbs are directed towards one another, and the ink slide has, perpendicular to its slide direction, a dimension adapted to the spacing between the two U-limbs of one wall part, such that it engages in its two end positions in the interior of the one or the other U-shaped wall part. In this manner, the ink slide functions as a type of plunger which almost completely displaces the ink within the U-shaped wall part.

The wiping device is preferably constructed as a pre-wiping device and operates with an actual pre-wiping cylinder, which rests against the plate cylinder, and with a second cylinder which consists of ceramic and receives the ink from the pre-wiping cylinder and is itself cleaned of ink by the doctor blade resting against it.

Further expedient designs emerge from the dependent claims.

BRIEF DESCRIPTION OF THE DRAWINGS

The invention is explained in detail by an exemplary embodiment of a pre-wiping device with reference to the drawing, in which:

FIG. 1 shows a diagrammatic illustration of a pre-wiping device interacting with a plate cylinder and having an actual pre-wiping cylinder and a second cylinder consisting of ceramic against which the doctor blade rests, FIG. 2 shows a plan view of the doctor blade and the cylinder interacting therewith.

DESCRIPTION OF THE PREFERRED EMBODIMENT

Figure 3:
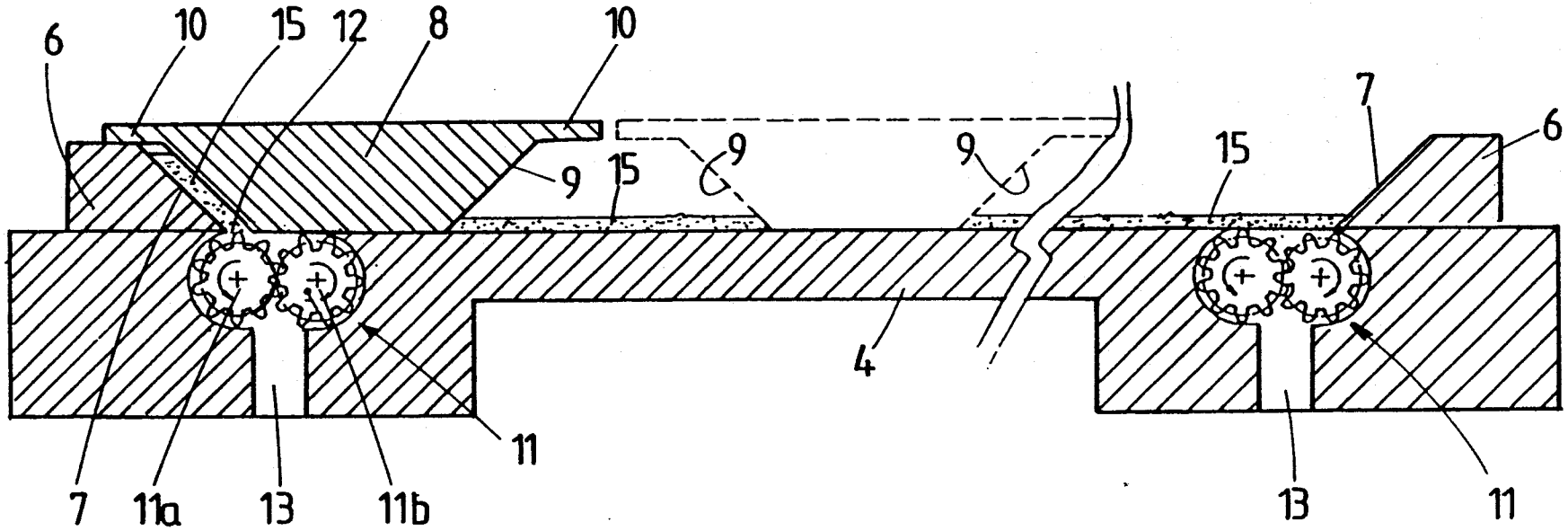
FIG. 3 shows a section along the line III—III according to FIG. 2.

In the example according to FIG. 1, the pre-wiping device consists of a pre-wiping cylinder 2, a cylinder 3 consisting of ceramic, a doctor blade 4 resting against the cylinder 3 and inclined obliquely downwards with its parts (explained later) for the lateral displacement of the ink, and two ink pumps 11 which are installed on both sides of these parts on the back of the doctor blade 4. The pre-wiping cylinder 2 rolls off on the printing plates (not illustrated) of a plate cylinder 1 belonging to an intaglio printing machine in order to press the ink into the line grooves and remove excess ink from the printing plates. The ink then passes onto the ceramic cylinder 3 rolling off on the pre-wiping cylinder 2 and is removed from its surface with the aid of the doctor blade 4.

Figure 4:
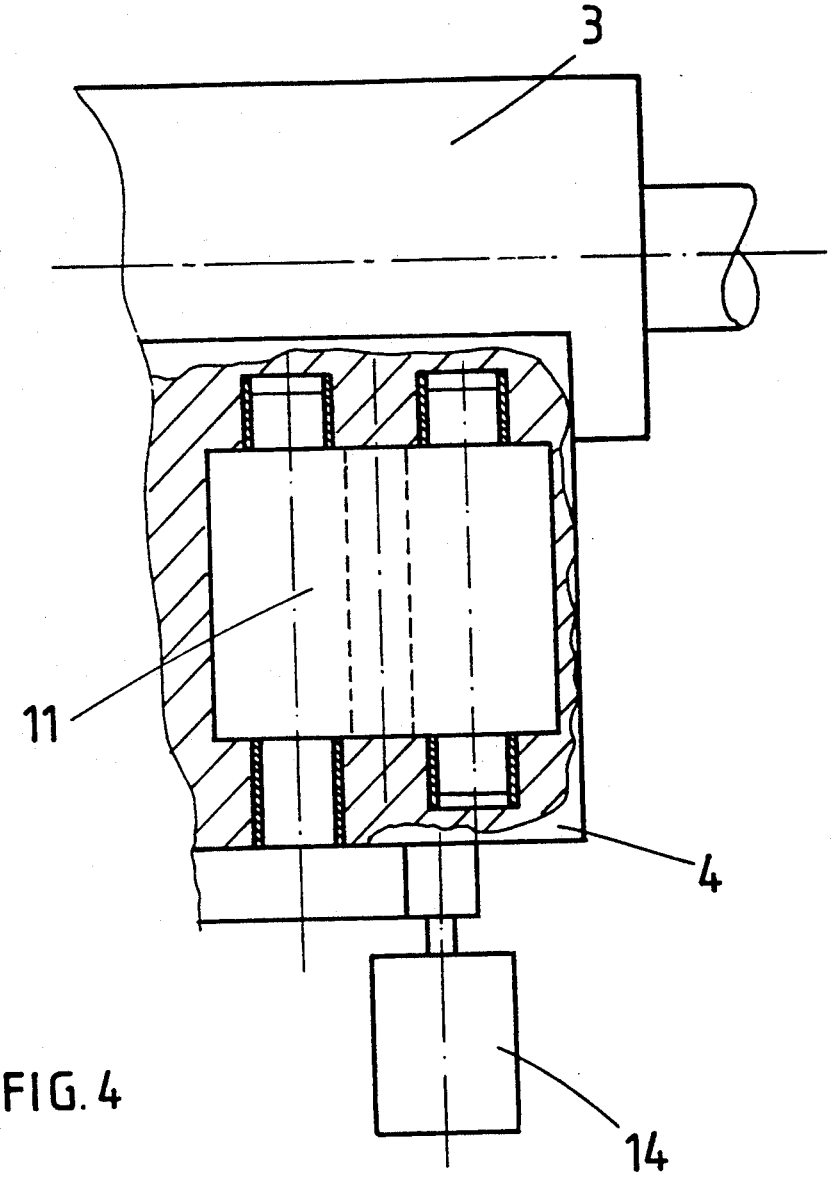
FIG. 4 shows a plan view, illustrated partially in section, of the right-hand ink pump according to FIG. 2.

In order now to remove the generally viscous intaglio printing ink completely from the doctor blade 4 without intervening by hand, the parts described below with reference to FIGS. 2 to 4 are installed on the doctor blade 4. Wall parts 6 are attached to the opposite side edges of the doctor blade 4 on the surface thereof, which wall parts are of U-shaped construction in the plan view. The central portions **6*b* or the bases of these U-shaped wall parts have inclined inside surfaces 7 and run parallel to the side edges of the doctor blade 4, while their U-limbs 6*a* are directed towards one another and are located opposite one another. These two lateral wall parts 6 bound between them a zone denoted below as receiving region 5, into which the ink 15 flowing downwards on the doctor blade surface passes. Situated on this receiving region 5 is an ink slide 8 which is constantly moved back and forth mechanically in the transverse direction of the doctor blade 4 between the two wall parts 6 in the direction of the double arrow, and the ink 15 passing into the receiving region 5 is pushed in this manner alternately into the interior of the one and of the other U-shaped wall part 6**.

Installed on each side of the doctor blade 4 below the plane of the receiving region 5 is an ink pump 11 whose inlet opening 12 of slot-shaped construction opens out into the receiving region 5 between the two U-limbs **6*a* of the wall part 6 and extends along the lower edge of the inner surface 7 of this wall part 6. In the example examined, the ink pump 11 is a gear pump having two gearwheels 11*a*, 11*b* which mesh with one another and whose axes run parallel to the slot-shaped inlet opening 12 and extend over the entire length of this inlet opening, that is to say over the entire spacing between the two U-limbs 6*a*. The outlet openings 13 of the two ink pumps 11 are connected to a container (not illustrated) to receive the ink. Each ink pump 11 is driven by a drive 14**.

In order to facilitate the displacement of the ink passing into the receiving region 5 towards the one or the other inlet opening 12, the ink slide 8 has, perpendicular to the slide direction, a dimension which is adapted to the spacing between the two U-limbs **6*a* of one wall part 6, such that it can engage in any end position in the interior of the relevant wall part 6. Furthermore, in the example examined, the ink slide 8 has in cross-section the shape of an inverted V and slides with the V-tip or its apex edge on the receiving region 5; the two obliquely outwardly inclined side surfaces 9 of the ink slide 8, which push the ink 15 in front of them, have the same inclination and almost the same width as the inner surface 7, facing them, of the central portion 6*b* of the relevant wall part 6. Additionally, the ink slide 8 has on its upper side a covering wall 10 which projects in the manner of a roof on all sides, is parallel to the surface of the receiving region 5 and has a spacing therefrom which corresponds to the height of the wall parts 6; as a result, the relevant wall part 6 is overlapped by the covering wall 10 in any end position of the ink slide 8 and the inside space bounded by the wall part 6** is thus closed at the top.

Due to the mutually complementary design of the ink slide 8 and wall parts 6, the ink slide acts like a plunger which, in its end position, almost completely fills the inside space between the U-limbs **6*a* which is closed virtually on all sides. During each stroke of the ink slide 8, virtually the entire ink 15 is therefore displaced from the receiving region 5 of the doctor blade 4 and squeezed into the relevant inlet opening 12 of the ink pump 11** from where it is conveyed into the inkreceiving container. The arrangement thus guarantees reliable removal of the ink from the doctor blade during the printing operation.

Any known slide mechanism with movement reversal can be used for the automatic back and forth movement of the ink slide 8.

If appropriate, the abovementioned receiving region 5 of the doctor blade 4 can be formed by a troughshaped depression which is provided in said doctor blade and to whose ends the wall parts 6 are attached and in which the ink slide 8 is moved back and forth.

The invention is not restricted to the exemplary embodiment described, but allows a multitude of variants in particular in the design and shape of the wall parts and of the ink slide and also in respect of the construction of the wiping device and the ink pumps.

We claim:

1. Wiping device of an intaglio printing machine having at least one cylinder (3) onto which the ink raised from the printing plates is transferred, and having a doctor blade (4) resting against said cylinder (3) for removing the ink from the cylinder surface, characterised in that there are arranged on the downwardly inclined doctor blade (4) wall parts (6) which are located laterally opposite one another and, between these wall parts, an ink slide (8), which is movable back and forth on the doctor blade surface by means of a drive device, in the form of a displacement body adapted on both sides to the wall parts (6), and in that there is installed on each side below the doctor blade surface an ink pump (11) whose inlet opening (12) opens out on the doctor blade surface and extends along the lower edge of an inner surface (7) of a respective said wall part (6) in such a way that the ink passing between the two wall parts (6) is displaced by the ink slide (8) alternately to the one and to the other inlet opening (12), where it is conveyed away by the relevant ink pump (11).

2. Wiping device according to claim 1, characterised in that the ink slide (8) and the wall parts (6) are constructed to be complementary to one another in such a way that, prior to the ink slide (8) reaching the one or the other end position, the ink displaced by it passes into a space which is at least virtually completely closed by walls of the ink slide (8) and of the respective wall part (6) and which is almost completely filled by the ink slide in the end position thereof.

3. Wiping device according to claim 1, characterised in that the two wall parts (6) are of U-shaped construction in the plan view and their U-limbs (**6*a*) are directed towards one another, and in that the ink slide (8) has, perpendicular to its slide direction, a dimension adapted to the spacing between the two U-limbs (6*a*) of one wall part (6), such that it engages in its two end positions in the interior of the one or the other U-shaped wall part (6**).

4. Wiping device according to claim 2, characterised in that the ink slide (8) has on its upper side a roof-shaped covering wall (10) which projects towards all sides and whose spacing from the doctor blade surface corresponds to the height of the wall parts (6), such that, in the one or the other end position of the ink slide (8) engaging in one of the wall parts (6), the relevant parts of the covering wall (10) overlap said one wall part and cover its interior.

5. Wiping device according to claim 1, characterised in that the ink slide (8) is V-shaped in cross-section and rests with its V-tip on the doctor blade surface, and in that the inner surface (7) of the portion (6*b*) of each wall part (6) oriented parallel to the side edge of the doctor blade (4) has the same inclination as a side surface (9) of the ink slide (8) located opposite said inner surface.

6. Wiping device according to claim 1, characterised in that the ink pumps (11) are gear pumps whose gear-wheels (11*a*, 11*b*) meshing with one another have in the axial direction a length corresponding to the longitudinal dimension of the inlet openings (12).

7. Wiping device according to claim 1, characterised in that the doctor blade (4) has a troughshaped depression which extends in the transverse direction and constitutes a receiving region (5) for the ink flowing down, and in which there are arranged laterally the abovementioned wall parts (6) and the ink slide (8) gliding along on the bottom of the depression between said wall parts.

8. Wiping device according to claim 1, further including a plate cylinder of a line intaglio printing machine, a pre-wiping cylinder (2) engaging said plate cylinder, said one cylinder comprising a ceramic cylinder (3).

* * * * *